US009315030B2

(12) United States Patent
Boyd et al.

(10) Patent No.: US 9,315,030 B2
(45) Date of Patent: Apr. 19, 2016

(54) FLUID CONTAINER HAVING PLURALITY OF CHAMBERS AND VALVES

(75) Inventors: Patrick V Boyd, Albany, OR (US); David Olsen, Corvallis, OR (US); Patricia A Kellar, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/977,216

(22) PCT Filed: Jan. 7, 2011

(86) PCT No.: PCT/US2011/020481
§ 371 (c)(1),
(2), (4) Date: Jun. 28, 2013

(87) PCT Pub. No.: WO2012/094012
PCT Pub. Date: Jul. 12, 2012

(65) Prior Publication Data

US 2013/0271534 A1 Oct. 17, 2013

(51) Int. Cl.
*B41J 2/175* (2006.01)
*B65D 83/00* (2006.01)

(52) U.S. Cl.
CPC ..... *B41J 2/175* (2013.01); *B41J 2/17513* (2013.01); *B65D 83/0055* (2013.01)

(58) Field of Classification Search
CPC ..... B41J 2/17513
USPC ..... 347/85, 86
See application file for complete search history.

(56) References Cited

U.S. PATENT DOCUMENTS

| | | | |
|---|---|---|---|
| 1,641,756 | A | 9/1927 | Hass |
| 2,476,310 | A | 9/1949 | Langdon |
| 2,707,969 | A | 5/1955 | Landon |
| 3,515,169 | A | 6/1970 | Berg et al. |
| 4,450,375 | A | 5/1984 | Siegal |
| 4,771,204 | A | 9/1988 | Siegal |

(Continued)

FOREIGN PATENT DOCUMENTS

| | | |
|---|---|---|
| CN | 85203707 | 9/1986 |
| CN | 1535833 | 10/2004 |

(Continued)

OTHER PUBLICATIONS

International Search Report and Written Opinon for PCT Application No. PCT/US2011/020481, dated Oct. 4, 2011, pp. 13.

(Continued)

*Primary Examiner* — Stephen Meier
*Assistant Examiner* — Alexander D Shenderov
(74) *Attorney, Agent, or Firm* — HP Inc. Patent Development

(57) ABSTRACT

A fluid container usable with an image forming apparatus is disclosed. The fluid container includes a housing unit, a free-fluid chamber disposed in the housing unit and configured to store fluid, and a regulated chamber disposed in the housing unit. The regulated chamber includes a regulator unit, an outlet and a plurality of states. The regulator unit is configured to regulate respective fluid therein. The outlet is configured to transport the respective fluid from the regulated chamber. The fluid container also includes a plurality of valves disposed in the housing unit. At least one of the valves is configured to selectively stop fluid communication between the regulated chamber and the free-fluid chamber based on the respective state of the regulated chamber.

18 Claims, 9 Drawing Sheets

(56) References Cited

U.S. PATENT DOCUMENTS

| | | | | |
|---|---|---|---|---|
| 5,737,001 | A | 4/1998 | Taylor | |
| 5,912,689 | A | 6/1999 | Otsuka et al. | |
| 6,145,974 | A | 11/2000 | Shinada et al. | |
| 6,203,148 | B1 | 3/2001 | Kishida | |
| 6,220,702 | B1 | 4/2001 | Nakamura et al. | |
| 6,267,473 | B1 | 7/2001 | Smith | |
| 6,296,354 | B1 | 10/2001 | Hashimoto | |
| 6,390,611 | B1 | 5/2002 | Kobayashi et al. | |
| 6,533,403 | B2 | 3/2003 | Hou et al. | |
| 6,651,955 | B2 | 11/2003 | Anderson | |
| 6,698,870 | B2 | 3/2004 | Gunther | |
| 6,758,558 | B2 | 7/2004 | Chiu et al. | |
| 6,773,097 | B2 | 8/2004 | Dowell | |
| 6,834,677 | B2 | 12/2004 | Barinaga et al. | |
| 7,178,907 | B2 | 2/2007 | Hagen et al. | |
| 7,429,101 | B2 | 9/2008 | Petersen et al. | |
| 7,431,440 | B2 | 10/2008 | Silverbrook et al. | |
| 7,438,399 | B2 | 10/2008 | Hibbard et al. | |
| 7,445,323 | B2 | 11/2008 | Anderson et al. | |
| 7,448,739 | B2 | 11/2008 | Hibbard et al. | |
| 7,556,365 | B2 | 7/2009 | Stathem | |
| 7,559,634 | B2 | 7/2009 | Miyazawa | |
| 7,618,135 | B2 | 11/2009 | Stathem et al. | |
| 7,654,665 | B2 | 2/2010 | Gray et al. | |
| 7,737,035 | B1 | 6/2010 | Lind et al. | |
| 7,744,832 | B2 | 6/2010 | Horacek et al. | |
| 7,762,651 | B2 | 7/2010 | Stathem et al. | |
| 7,971,965 | B2 | 7/2011 | Silverbrook et al. | |
| 2002/0109760 | A1 | 8/2002 | Miyazawa et al. | |
| 2003/0122907 | A1 | 7/2003 | Kim | |
| 2003/0128257 | A1* | 7/2003 | Qingguo et al. | 347/85 |
| 2004/0017444 | A1 | 1/2004 | Gunther | |
| 2004/0207687 | A1 | 10/2004 | Silverbrook | |
| 2008/0266370 | A1 | 10/2008 | Haines et al. | |
| 2008/0297546 | A1 | 12/2008 | Lee et al. | |
| 2008/0309738 | A1 | 12/2008 | Yan | |
| 2009/0000675 | A1 | 1/2009 | Baros et al. | |
| 2009/0096849 | A1 | 4/2009 | Kanbe et al. | |
| 2009/0108222 | A1 | 4/2009 | Spiers et al. | |
| 2009/0109267 | A1 | 4/2009 | Lee et al. | |
| 2010/0208010 | A1 | 8/2010 | Inoue et al. | |
| 2010/0245453 | A1 | 9/2010 | Stathem et al. | |
| 2010/0289856 | A1 | 11/2010 | Yamamoto et al. | |

FOREIGN PATENT DOCUMENTS

| | | | |
|---|---|---|---|
| CN | 1572512 | A | 2/2005 |
| CN | 1621237 | | 6/2005 |
| CN | 101073044 | | 11/2007 |
| CN | 101668637 | | 3/2010 |
| EP | 0109239 | | 5/1984 |
| EP | 1093922 | | 4/2001 |
| EP | 1287999 | A2 | 3/2003 |
| EP | 1327524 | A1 | 7/2003 |
| EP | 1384588 | A1 | 1/2004 |
| EP | 1464502 | A1 | 10/2004 |
| EP | 1524119 | | 4/2005 |
| GB | 1206556 | | 9/1970 |
| JP | 200458675 | A | 2/2004 |
| TW | 533135 | | 5/2003 |
| WO | WO-2005075205 | A1 | 8/2005 |
| WO | WO-2009049347 | A1 | 4/2009 |

OTHER PUBLICATIONS

International Search Report and Written Opinion for PCT Application No. PCT/US2011/020498, dated Sep. 14, 2011, pp. 8.

International Search Report and Written Opinion for PCT Application No. PCT/US2011/020521, dated Oct. 4, 2011, pp. 17.

* cited by examiner

| | HYPERINFLATION PRIMING AND/OR PURGING STATE | | |
|---|---|---|---|
| 18 | VALVES | OPEN | CLOSE |
| 48a | REGULATOR VALVE | | X |
| 48b | FREE-FLUID VALVE | | X |
| 48c | VENT VALVE | | X |
| 49 | CAPILLARY VALVE | | X |
| 48d | WET FLOW VALVE | | X |

55a

Fig. 5A

| | BACKPRESSURE REGULATION STATE | | |
|---|---|---|---|
| 18 | VALVES | OPEN | CLOSE |
| 48a | REGULATOR VALVE | X | |
| 48b | FREE-FLUID VALVE | X | |
| 48c | VENT VALVE | X | |
| 49 | CAPILLARY VALVE | X | |
| 48d | WET FLOW VALVE | X | |

55b

Fig. 5B

| | NORMAL AND/OR ALTITUDE ROBUST STATE | | |
|---|---|---|---|
| 18 | VALVES | OPEN | CLOSE |
| 48a | REGULATOR VALVE | | X |
| 48b | FREE-FLUID VALVE | | X |
| 48c | VENT VALVE | | X |
| 49 | CAPILLARY VALVE | | X |
| 48d | WET FLOW VALVE | X | |

55c

Fig. 5C

FLUID CONTAINER HAVING PLURALITY OF CHAMBERS AND VALVES

BACKGROUND

Fluid containers store fluid to be supplied to other devices. Fluid containers may include multiple chambers and be removably installed in devices such as image forming apparatuses to supply the fluid thereto. Generally, one or more chambers include regulator units to regulate the flow of the fluid in the fluid container and/or the device.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

FIGS. 5A, 5B and 5C are chart representational views illustrating states of the regulated chamber of the fluid container of FIG. 1 according to examples.

Throughout the drawings, identical reference numbers designate similar, but not necessarily identical, elements.

DETAILED DESCRIPTION

Figure 1:
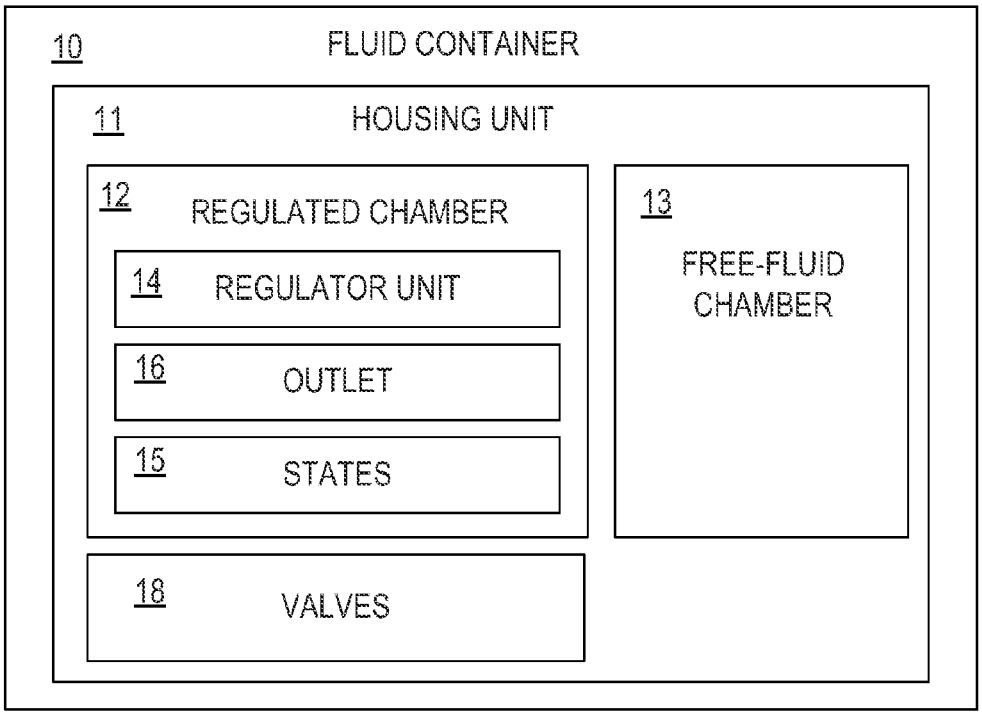
FIG. 1 is a block diagram illustrating a fluid container according to an example.

In the following detailed description, reference is made to the accompanying drawings which form a part hereof, and in which is illustrated by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Fluid containers store fluid to be supplied to other devices and are available in a variety of fluid storage capacities. Fluid containers may also be removably installed in devices such as image forming apparatuses to supply the fluid thereto. Such fluid containers may include regulator units to regulate the flow of fluid within and/or between the fluid container and, for example, the image forming apparatus. Generally, based at least on the respective fluid storage capacity of the fluid containers, the size, type and/or arrangement of regulator units vary within the respective fluid container. Such regulator unit variations exist even with respect to fluid containers having different fluid storage capacities that are still in the same fluid container family. Thus, such regulator unit variations may increase obstacles to create a common interface for fluid containers within the same fluid container family, increases the number of regulator parts, and increases manufacturing costs.

In the present disclosure, a fluid container is disclosed having a regulated chamber and a free-fluid chamber. The fluid storage capacity of the fluid container may be the combined fluid storage capacities of the regulated chamber and the free-fluid chamber. The free-fluid chamber can vary in size based on the desired fluid storage capacity for the respective fluid container. A regulator unit is disposed within the regulated chamber. Additionally, in examples, the fluid container includes a plurality of valves such that at least one of the valves is configured to selectively isolate the free-fluid chamber from the regulated chamber when the regulated chamber is in a respective state. That is, based on the respective state of the regulated chamber, at least one of the valves stops fluid communication from the regulated chamber to the free-fluid chamber. Thus, the size, type and arrangement of the regulator unit may be based on a predetermined fluid storage capacity of the regulated chamber. In examples, one or more of the valves may be check valves.

The respective state may be a pressurization state in which the regulator unit establishes positive pressure such as a hyperinflation priming and/or purging state. In this state, the additional fluid storage capacity of the free-fluid chamber does not impact the effectiveness of the regulator unit as the free-fluid chamber is isolated from the regulated chamber. In other states, however, such as a backpressure regulation state, the free-fluid chamber is not isolated from the regulated chamber allowing additional fluid to be provided thereto and available, for example, to print. Thus, fluid containers are disclosed in examples in which the same type, size and/or arrangement of a regulator unit disposed inside a regulated chamber may be used for fluid containers having a variety of fluid storage capacities. Accordingly, regulator unit variations may be reduced resulting in decreasing obstacles to creating a common interface for fluid containers within the same fluid container family, decreasing the number of regulator parts and reducing manufacturing costs.

Figure 2:
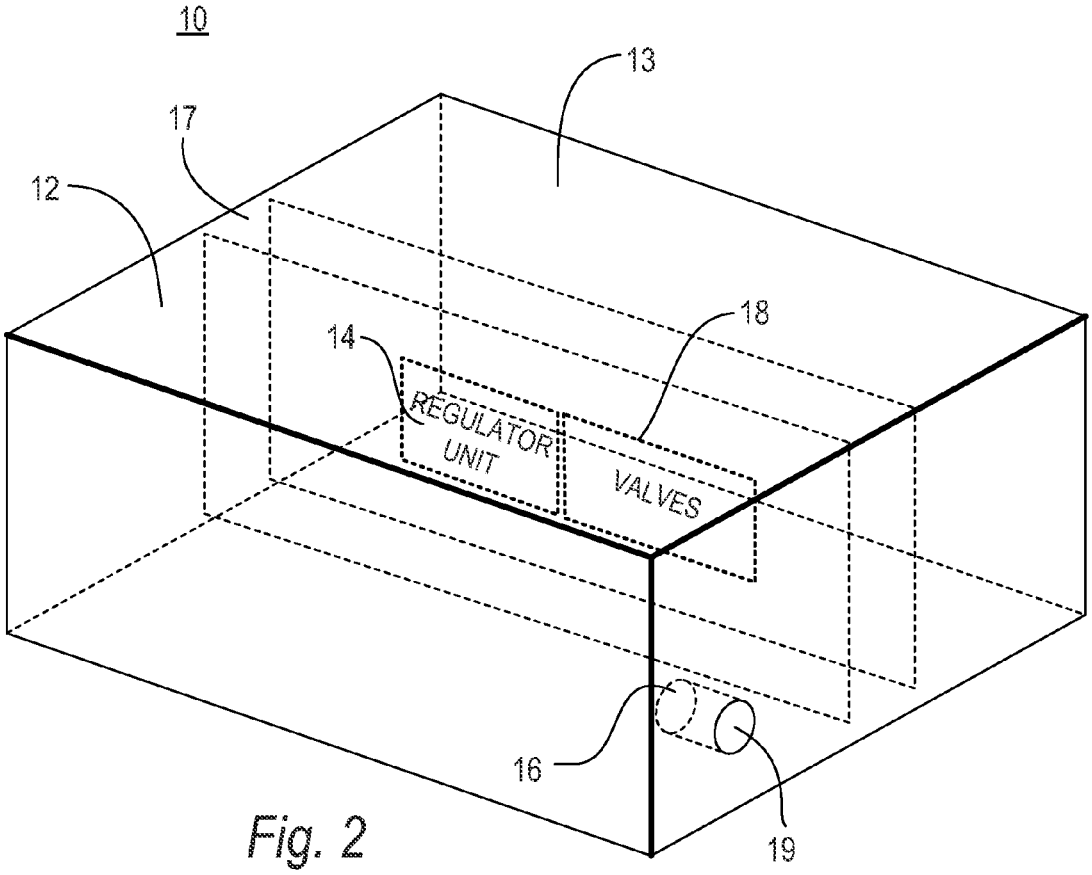
FIG. 2 is a perspective view illustrating a fluid container according to an example.
Figure 7:
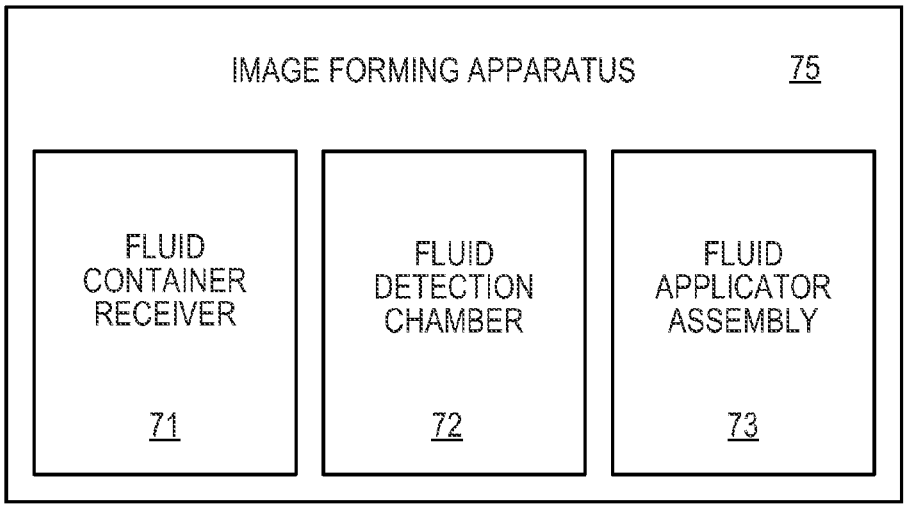
FIG. 7 is a block diagram illustrating an image forming apparatus according to an example.

FIG. 1 is a block diagram illustrating a fluid container according to an example. FIG. 2 is a perspective view illustrating a fluid container according to an example. The fluid container 10 may be usable with an image forming apparatus 75 (FIG. 7). Referring to FIGS. 1 and 2, in the present example, the fluid container 10 includes a housing unit 11, a free-fluid chamber 13 disposed in the housing unit 11 and configured to store fluid, and a regulated chamber 12 disposed in the housing unit 11. In an example, the free-fluid chamber 13 and the regulated chamber 12 may be adjacent to each other and share a common wall 17. The free-fluid chamber 13, for example, may be a passive free-fluid chamber. That is, the passive free-fluid chamber does not sense or actively control fluid pressure or flow.

Figure 3A:
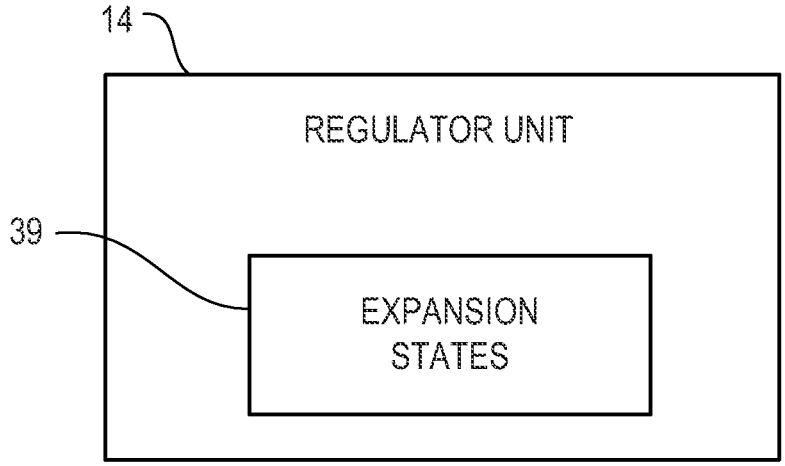
FIG. 3A is a block diagram illustrating a regulator unit of the fluid container according to an example.

Referring to FIGS. 1 and 2, the regulated chamber 12 includes the regulator unit 14 which is configured to regulate respective fluid therein and includes a plurality of states 15. The regulator unit 14 may include a plurality of expansion states 39 as illustrated in FIG. 3A. An expansion state 39 may correspond to a respective amount of expansion of the regulator unit 14. The regulator unit 14 may be in the form of one or more of a pump, a spring, a biasing mechanism, a variable-volume chamber and an expansion and contraction member. The outlet 16 is configured to transport the respective fluid from the regulated chamber 12. For example, the respective fluid may be transported to a fluid applicator assembly 73 external to the housing unit 11, other chambers within or outside the housing unit 11, or the like.

The fluid container 10 also includes a plurality of valves 18 disposed in the housing unit 11. In an example, at least one of the valves 18 is configured to selectively stop fluid communication between the regulated chamber 12 and the free-fluid chamber 13 based on the respective state of the regulated chamber 12. In examples, each of the valves 18 selectively isolates the free-fluid chamber 13 from the regulated chamber 12. That, is based on the respective state of the regulated chamber 12, the valves 18 selectively isolate the free-fluid chamber 13 from the regulated chamber 12. The fluid container 10 may also include one or more exterior openings 19 such as fluid interconnects, or the like, to establish communication between fluid chambers and the external environment such as an image forming apparatus 75 (FIG. 7) and/or ambient atmosphere.

Figure 4:
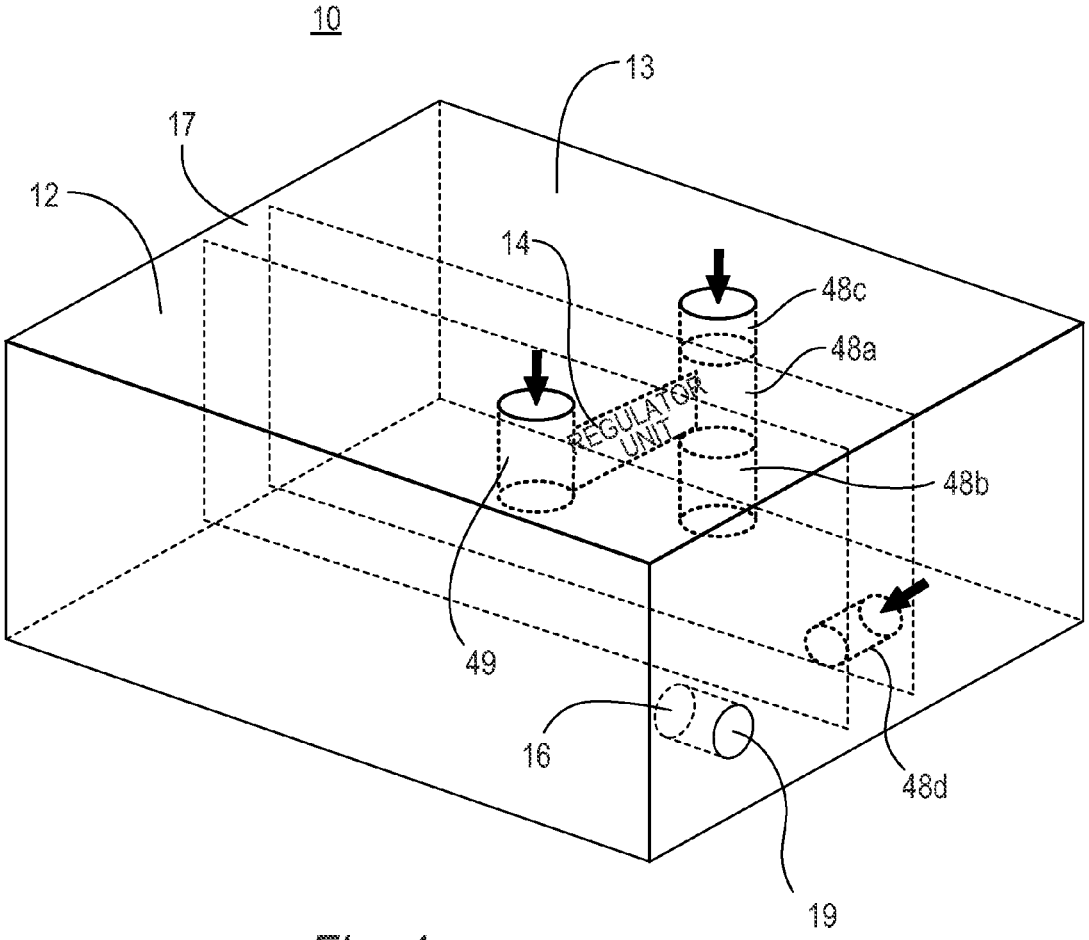
FIG. 4 is a perspective view illustrating the fluid container of FIG. 1 according to an example.

FIG. 4 is a perspective view illustrating the fluid container of FIG. 1 according to an example. Referring to FIGS. 1, 2 and 4, the plurality of valves 18 include at least two of a regulator valve 48*a*, a free-fluid valve 48*b*, a vent valve 48*c* and a wet flow valve 48*d*. In examples, one or more of the regulator valve 48*a*, the free-fluid valve 48*b*, the vent valve 48*c* and the wet flow valve 48*d* may be check valves. In the present example, each of the regulator valve 48*a*, the free-fluid valve 48*b*, the vent valve 48*c* and the wet flow valve 48*d* may be check valves. The fluid container 10 may also include a capillary relief valve 49 configured to selectively transport air from ambient atmosphere to the regulated chamber 12 based on a respective state 15 of the regulated chamber 12. For example, the respective state 15 may be at least one of a hyperinflation priming and/or purging state 55*a* (FIG. 5A) and a normal and/or altitude robust state 55*c* (FIG. 5C).

Figure 3B:
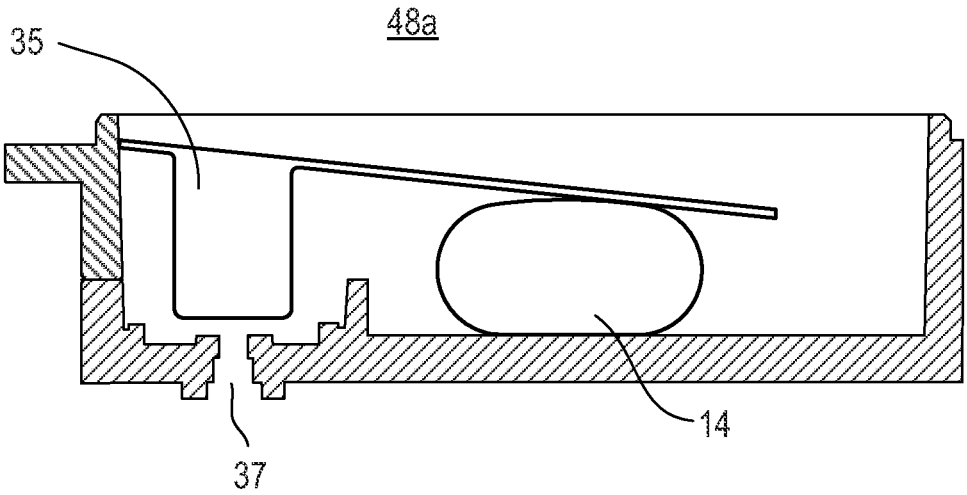
FIG. 3B is a side view of a regulator valve according to an example.

In an example, the wet flow valve 48*d* is configured to selectively establish fluid communication between the regulated chamber 12 and the free-fluid chamber 13. In examples, a wet flow valve 48*d* stays below the fluid level in the supply. The regulator valve 48*a* is configured to selectively establish fluid communication between the regulated chamber 12 and air outside of the housing unit 11 such as ambient atmosphere. For example, the regulator valve 48*a* may be a pilot-operated valve actuated by a lever actuator member 35 to selectively close one or more respective ports 37 in response to an expansion state 39 of the regulator unit 14 as illustrated in FIGS. 3A and 3B. In an example, the regulator unit 14 may be inflated and deflated through a pump, or the like (not illustrated).

In an example, the free-fluid valve 48*b* is configured to selectively establish fluid communication between the free-fluid chamber 13 and air outside the housing unit 11 such as ambient atmosphere. For example, the free-fluid valve 48*b* may be pressure-actuated based on a differential pressure between the free-fluid chamber 13 and the regulated chamber 12. The directional flow through the free-fluid valve 48*b* in an open state thereof is into the free-fluid chamber 13. In an example, the vent valve 48*c* is configured to selectively establish fluid communication between the ambient air and the free-fluid chamber 13. The vent valve 48*c* may be pressure-actuated based on a differential pressure between the ambient atmosphere and the free-fluid chamber 13. The directional flow through the vent valve 48*c* in an open state thereof is into the free-fluid chamber 13.

Referring to FIG. 4, in the present example, the plurality of valves 18 may include each of the regulator valve 48*a*, the free-fluid valve 48*b*, the vent valve 48*c*, the wet flow valve 48*d* and the capillary relief valve 49. In the present example, the vent valve 48*c*, regulator valve 48*a* and free-fluid valve 48*b* may be in series. That is, the regulator valve 48*a* is disposed between the vent valve 48*c* and the free-fluid valve 48*b*. The regulator valve 48*a* selectively receives air from the ambient atmosphere through the vent valve 48*c* and selectively transports the air to the free-fluid chamber 13 through the free-fluid valve 48*b*.

In examples, the respective valves 18 may be either normally open or closed. In the present example, the wet flow valve 48*d* includes a normally open pressure-actuated valve. The regulator valve 48*a* includes a pilot-operated regulator valve 48*a*. The regulator valve 48*a* may also include a lever actuator member 35 configured to move to selectively open and close a port 37 corresponding to the respective expansion state 39 of the regulator unit 14 as illustrated in FIGS. 3A and 3B. The free-fluid valve 48*b* includes a normally open pressure-actuated valve. The vent valve 48*c* includes a normally open pressure-actuated valve. The capillary relief valve 49 includes a normally closed relief valve.

In a printing operation, for example, the fluid container 10 may be coupled to an image forming apparatus 75 (FIG. 7) through one or more external openings 19 such as an inkjet printer to supply fluid such as ink to a fluid applicator assembly 73 (FIG. 7) such as a print head assembly to be printed on a media. Ink from the regulated chamber 12 may be transported through the outlet 16 and external opening 19 to a print head assembly to selectively print ink on the media. The ink from the free-fluid chamber 13 is transported (e.g., flows) through the wet flow valve 49 into the regulated chamber 12. Air flows from ambient atmosphere through each of the vent valve 48*c*, the regulated valve 48*a* and the free-fluid valve 48*b* into the free-fluid chamber 13 to replace the ink that previously flowed into the regulated chamber 12.

FIGS. 5A, 5B and 5C are chart representational views illustrating states of the regulated chamber of the fluid container of FIG. 1 according to examples. In examples, the plurality of states 15 may be a combination of pressurization and depressurization states. Referring to FIGS. 5A-5C, in the present example, the states 15 include a hyperinflation priming and/or purging state 55*a* (FIG. 5A), a backpressure regulation state 55*b* (FIG. 5B), and a normal and/or altitude robust state 55*c* (FIG. 5C). In the hyperinflation priming and/or purging state 55*a*, the regulator unit 14 is configured to pressurize the regulated chamber 12 to a positive pressure to perform at least one of a priming function and a purging function, such that the wet flow valve 48*d* is closed. That is, the regulated chamber 12 has a greater pressure than the free-fluid chamber 13. Further, the regulator valve 48*a* is closed, the free-fluid valve 48*b* is closed, the vent valve 48*c* is closed, and a capillary relief valve 49 is closed.

Figure 10A:
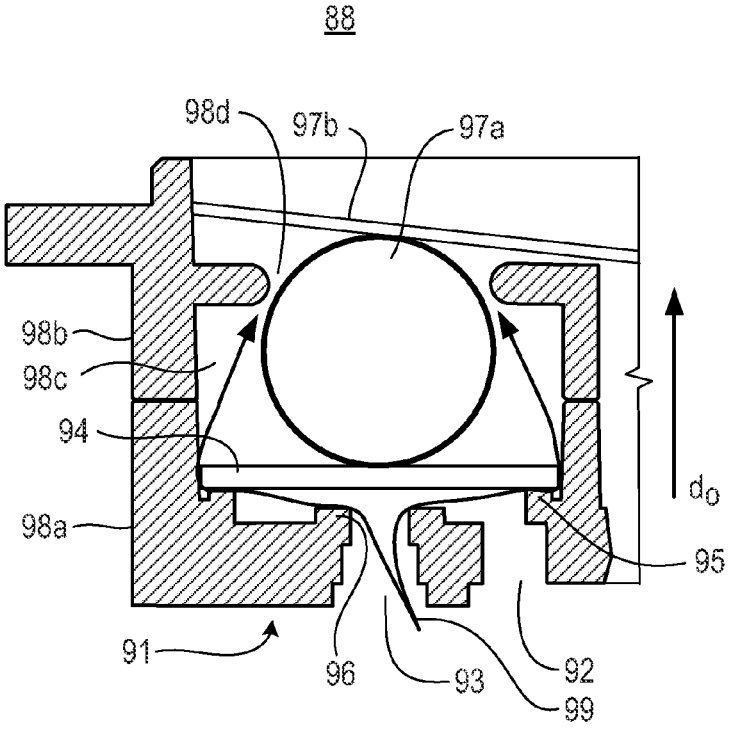
FIGS. 10A, 10B and 10C are cross-sectional views illustrating the integrated multifunctional valve device of FIG. 9 in an assembled form according to examples.
Figure 10B:
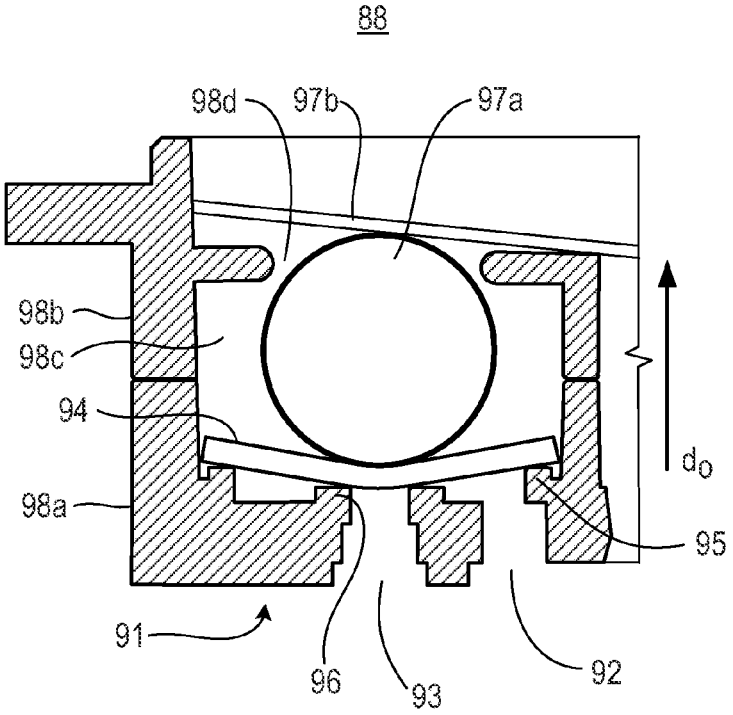
Figure 10C:
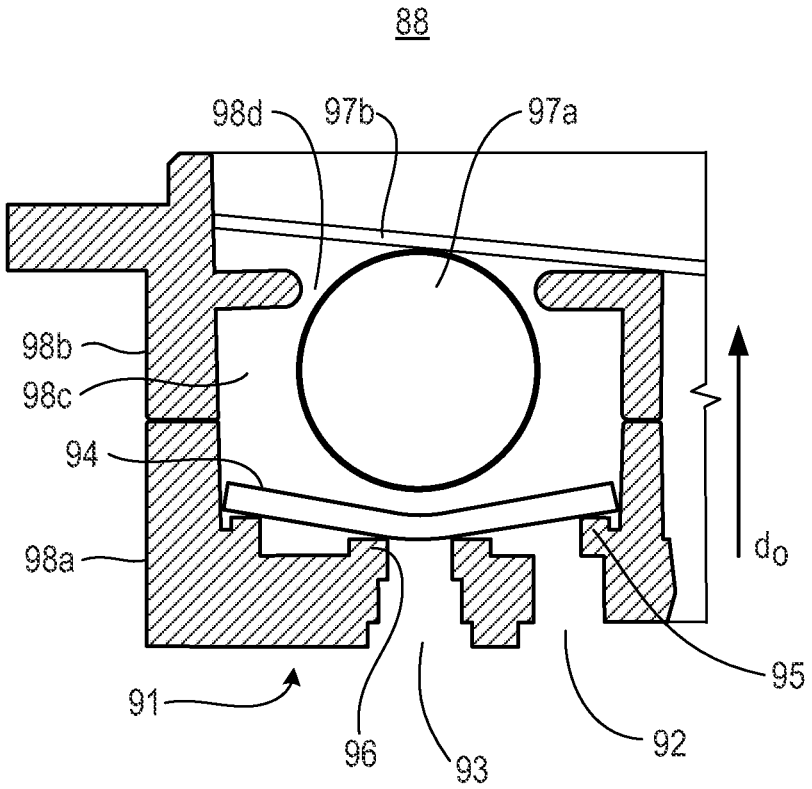

Referring to FIGS. 5A and 10C, for example, in operation in the hyperinflation priming and/or purging state 55*a*, the regulator unit 14 expands pressurizing the regulated chamber 12 and, for example, moving a lever member 97*b* in a direction away from a respective port 93. The actuator ball 97*a* also moves away from the respective port 93. However, pressure within the regulated chamber 12 places a flexible disk member 94 into a closed port position and closes the wet flow valve 48*d*. That is, the flexible disk member 94 is urged toward and against the respective port 93 to cover it isolating the free-fluid chamber 13 from the regulated chamber 12. In an example, the capillary relief valve 49 is closed Referring to FIGS. 5B and 10A, in the backpressure regulation state 55*b*, the regulator unit 14 is configured to form a negative pressure in the regulated chamber 12 to perform a controlled fluid delivery function, such that the wet flow valve 48*d* is open, the regulator valve 48*a* is open, the free-fluid valve 48*b* is open, the vent valve 48*c* is open, and a capillary relief valve 49 is open. That is, pressure in the regulated chamber 12 is less than pressure in the free-fluid chamber 13. For example, in operation in the backpressure regulation state 55*b*, back pressure expands the regulator unit 14 pressurizing the regulated chamber 12 and, for example, moving a lever member 97*b* in a direction away from the respective port 93. The actuator ball 97*a* also moves away from the respective port 93. The flexible disk member 94 is placed in an open port position and the wet flow valve 48*d* is placed into an open position. That is, air flows through the vent valve 48*c* and free-fluid valve 48*b* into the free-fluid chamber 13. Also, fluid flows from the free-fluid chamber 13 through the wet flow valve 48*d* into the regulated chamber 12. In an example, the capillary relief valve 49 is open. Thus, air passes through the capillary relief valve 49 into the regulated chamber 12, for example, along a capillary path 99.

As illustrated in FIGS. 5C and 10B, in the normal and/or altitude robust state 55*c*, the regulator unit 14 is in a partially expanded state configured to form a negative pressure in the regulated chamber 12 to perform at least a leak prevention function, such that the wet flow valve 48*d* is open, the regulator valve 48*a* is closed, the free-fluid valve 48*b* is closed, the vent valve 48*c* is closed, and a capillary relief valve 49 is closed. For example, in operation in the normal and/or altitude robust state 55*c*, the regulator unit 14 partially expands. The flexible disk member 94 is urged against the respective port, for example, by the lever member 97*b* and/or actuator ball 97*a*, or the like. Thus, the flexible disk member 94 is placed in a closed port position restricting air from flowing into the free-fluid chamber 13 through the vent valve 48*c* and free-fluid valve 48*b*. The wet flow valve 48*d* is in an open position allowing fluid to flow into the regulated chamber 12 as the pressure in the regulated chamber 12 is less than the pressure in the free-fluid chamber 13. In an example, the capillary relief valve 49 is closed.

Figure 6:
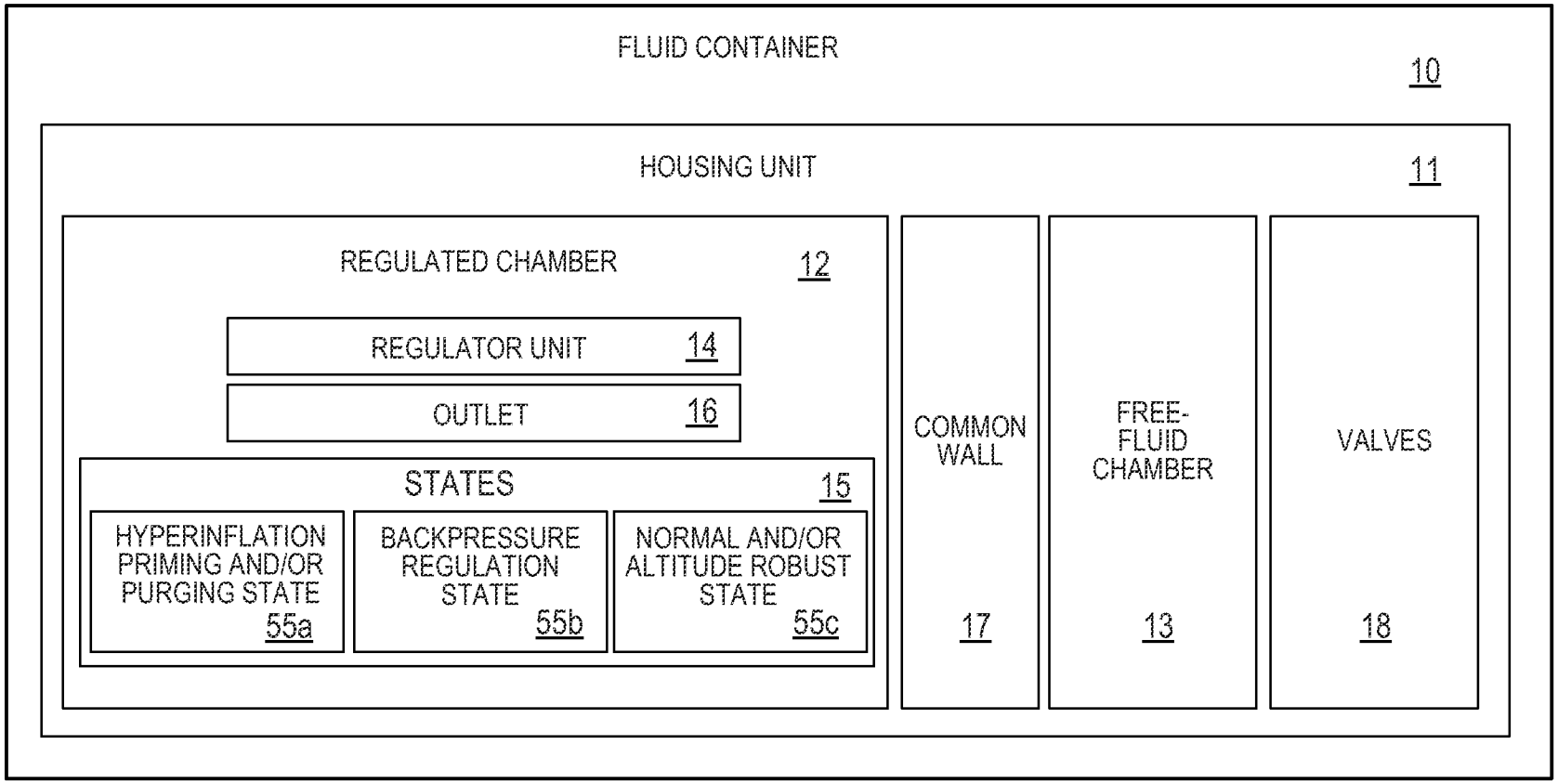
FIG. 6 is a block diagram illustrating the fluid container of FIG. 1 according to an example.

FIG. 6 is a block diagram illustrating the fluid container of FIG. 1 according to an example. FIG. 7 is a block diagram illustrating an image forming apparatus according to an example. Referring to FIGS. 6 and 7, the fluid container 10 may be usable with an image forming apparatus 75 having a fluid container receiver 71, fluid detection chamber 72 and a fluid applicator assembly 73. Referring to FIG. 6, the fluid container 10 includes a housing unit 11 including a free-fluid chamber 13 and a regulated chamber 12 configured to store fluid. In an example, the regulated chamber 12 and the free-fluid chamber 13 may be adjacent to each other and separated by a common wall 17. The regulated chamber 12 includes a regulator unit 14 configured to regulate respective fluid therein and an outlet 16 configured to transport the respective fluid from the regulated chamber 12, for example to another chamber and/or fluid applicator assembly (FIG. 7) inside or outside the housing unit 11. The regulated chamber 12 also includes a plurality of states 15, for example, a hyperinflation priming and/or purging state 55*a*, a backpressure regulation state 55*b*, and a normal and/or altitude robust state 55*c*.

Referring to FIG. 6, the fluid container 10 includes a plurality of valves 18 disposed in the housing unit 11. In an example, at least one of the valves 18 is configured to selectively isolate the free-fluid chamber 13 from the regulated chamber 12 in response to the regulated chamber 12 entering a pressurized state such as the hyperinflation priming and/or purging state 55*a* (FIG. 5A). That is, at least one of the valves 18 stops fluid communication from the regulated chamber 12 to the free-fluid chamber 13 in response to the regulated chamber 12 entering the hyperinflation priming and/or purging state 55*a* (FIG. 5A). In the present example, in the hyperinflation priming and/or purging state 55*a*, the regulator unit 14 is configured to pressurize the regulated chamber 12 to a positive pressure to perform at least one of a priming function and a purging function. That is, pressure in the regulated chamber 12 is greater than pressure in the free-fluid chamber 13. Accordingly, the priming function and/or purging function may be applied to one or more of the fluid detection chamber 72, the regulated chamber 12 and the fluid applicator assembly 73 in response to the regulated chamber 12 entering the hyperinflation priming and/or purging state 55*a* as previously discussed and illustrated in FIG. 5A.

In an example, in the backpressure regulation state 55*b*, the regulator unit 14 is configured to form a negative pressure in the regulated chamber 12 to perform a controlled fluid delivery function as previously discussed and illustrated in FIG. 5B. In the normal and/or altitude robust state 55*c*, the regulator unit 14 is in a partially expanded state configured to form a negative pressure in the regulated chamber 12 to perform at least a leak prevention function as previously discussed and illustrated in FIG. 5C.

Referring to FIGS. 6 and 7, in an example, the fluid container receiver 71 receives a respective fluid container 10 to establish fluid communication with the image forming apparatus 75. The fluid detection chamber 72, for example, may include a chamber (not illustrated) and detection members (not illustrated) to detect the presence and/or amount of fluid in the fluid container 10. The fluid applicator assembly 73 may apply fluid to a media. For example, the fluid applicator assembly 73 may be a print head assembly to eject ink onto paper, or the like. In the present example, the fluid detection chamber 72 and the fluid applicator assembly 73 are disposed in the image forming apparatus 75 and in fluid communication with the regulated chamber 12 of the fluid container 10.

Figure 8:
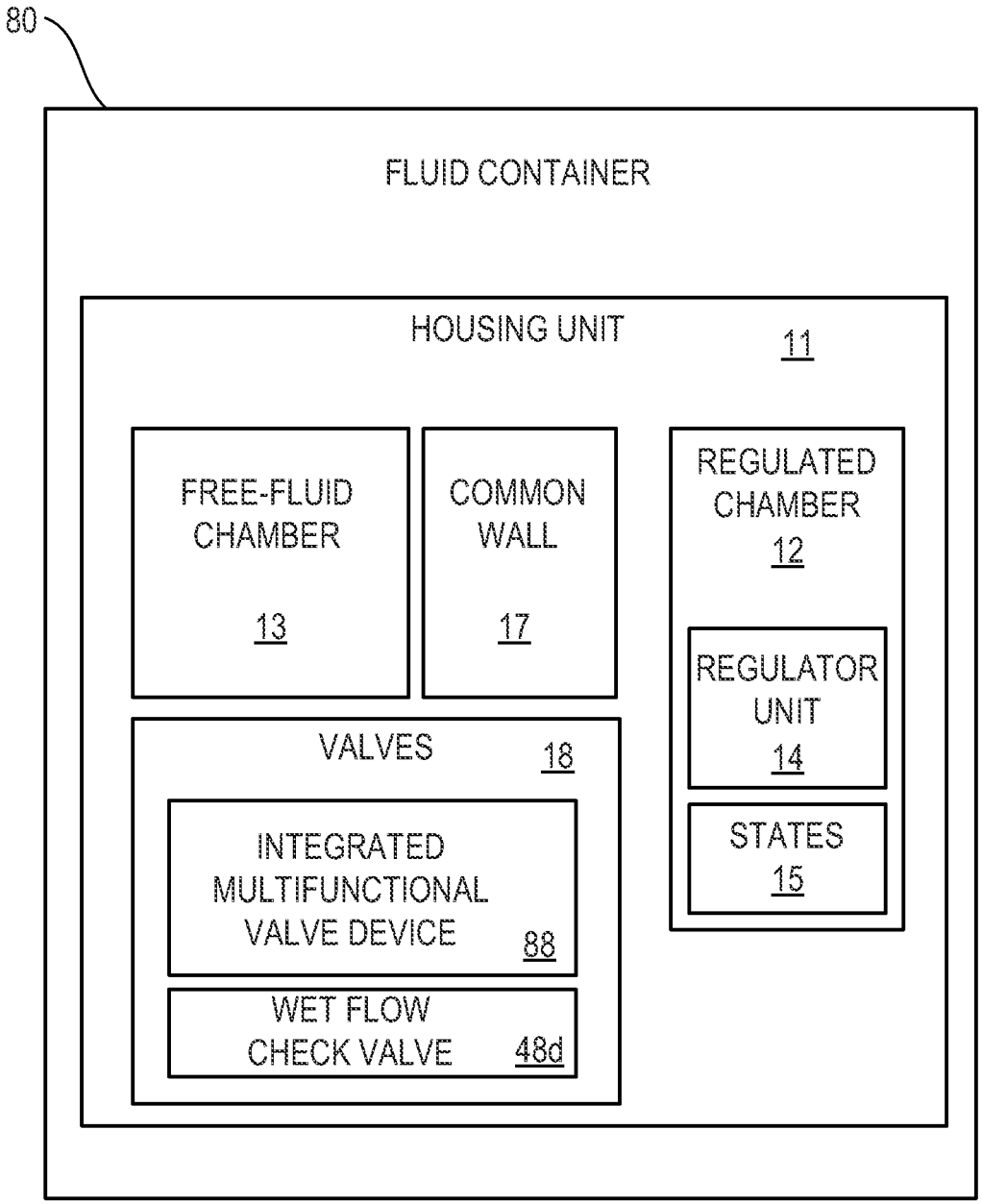
FIG. 8 is a block diagram illustrating a fluid container including an integrated multifunctional valve device according to an example.

FIG. 8 is a block diagram illustrating a fluid container including an integrated multifunctional valve device according to an example. The fluid container 80 of FIG. 8 corresponds to the fluid container 10 previously described with respect to FIG. 1. Additionally, the fluid container 80 of FIG. 8 includes an integrated multifunctional valve device 88 and a wet flow valve 48*d* corresponding to the plurality of valves 18 of the fluid container 10 illustrated in FIG. 1. In the present example, each of the integrated multifunctional valve device 88 and the wet flow valve 48*d* selectively isolate the free-fluid chamber 13 and the regulated chamber 12. That is, fluid communication between is selectively stopped between the free-fluid chamber 13 and the regulated chamber 12.

Figure 9:
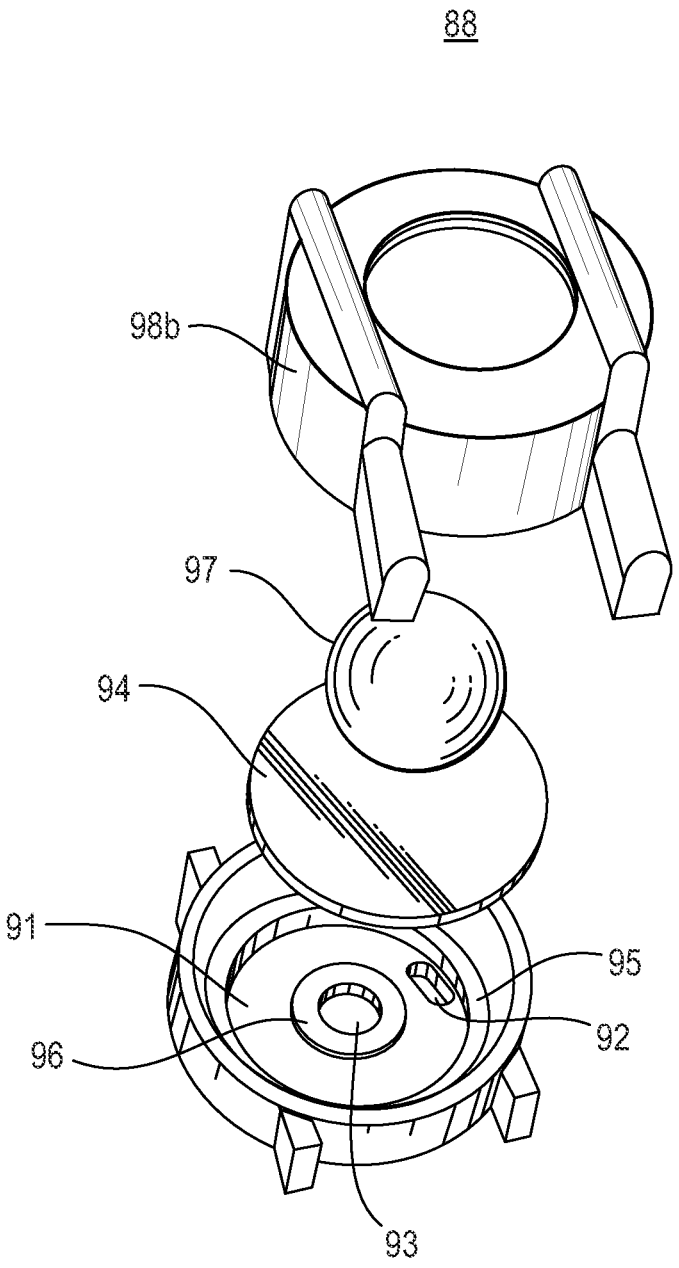
FIG. 9 is a perspective view illustrating an integrated multifunctional valve device in a disassembled form according to an example.

FIG. 9 is a perspective view illustrating an integrated multifunctional valve device in a disassembled form according to an example. FIGS. 10A-10C are cross-sectional views illustrating the integrated multifunctional valve device of FIG. 9 in an assembled form according to examples. The integrated multifunctional valve device 88 may be usable with a fluid container 80, for example, to direct fluid to, from and/or within the fluid container 80. Referring to FIGS. 9-10C, in the present example, the integrated multifunctional valve device 88 may include a surface member 97 having a first port 92 and a second port 93 formed therein, a flexible disk member 94, a first seat member 95 extending outward from the surface member 91, a second seat member 96 extending outward from the surface member 91 and an actuator member 97. The outward direction $d_o$, for example, is a direction substantially perpendicular to and away from a surface portion of the surface member 91 in which the respective ports (92 and 93) and are formed. In the present example, the surface member 91 may be a portion of the fluid container 80 such as a housing portion and/or wall portion thereof. In other examples, the surface member 91 may be separate and attachable to the fluid container 80. In an example, the fluid container 80 may also include a first housing member 98*a*, a second housing member 98*b*, and a capillary path 99. The first housing member 98*a* and the second housing member 98*b* form an enclosed chamber 98*c* therebetween.

Referring to FIGS. 9-10C, the first housing member 98*a* may extend outward from the surface member 91 to surround the first port 92, the second port 93, the first seat member 95, the second seat member 96 and the flexible disk member 94. In an example, the first housing member 98*a* and the surface member 91 may be a unitary member. In other examples, the first housing member 98*a* may be formed separately, disposed opposite and/or coupled to the surface member 91, for example, through positioning components (not illustrated), adhesives, friction-fit arrangement, or the like. In examples, the second housing member 98*b* may be permanently or removably coupled to the second housing member 98*b*. The second housing member 98*b* includes an access opening 98*d* to provide access to inside and outside of the enclosed chamber 98*c*.

Referring to FIGS. 9-10C, in the present example, the integrated multifunctional valve device 88 includes an integrated regulator valve 48*a*, a first pressure-actuated valve and a second pressure-actuated valve. The regulator valve 48*a* includes an actuator member such as the lever member 97*b* and an actuator ball 97*a*, the flexible disk member 94, the first seat member 95, the second seat member 96, the first port 92 and the second port 93. The regulator valve 48*a* has an open state corresponding to the open port position of the flexible disk member 94 and a closed state corresponding to the close port position of the flexible disk member 94. In the open port position, the flexible disk member 94 moves away from the second seat member 96. That is, the flexible disk member 94 moves away from the respective port 93. Thus, in the open state of the regulator valve 48*a*, the regulator valve 48*a* establishes fluid communication between the first port 92 and the second port 93. In the close port position, the flexible disk member 94 is urged against and extends across the first seat member 95 and the second seat member 96. That is, the flexible disk member 94 is urged towards the respective port 93. Thus, in the closed state of the regulator valve 48*a*, the regulator valve 48*a* stops the fluid communication between the first port 92 and the second port 93.

Referring to FIGS. 9-10C, in the present example, the integrated multifunctional valve device 88 includes the flexible disk member 94, the first seat member 95, the second seat member 96 and the first port 92 to form a first pressure-actuated valve corresponding to the open state of the regulator valve 48*a*. The flexible disk member 94, the second seat member 96 and the second port 93 form a second pressure-actuated valve corresponding to the open state of the regulator valve 48*a*. That is, adequate pressure may urge at least a portion of the flexible disk member 94 against the second seat member 96 thereby covering the second port 93, even when the lever member 97*b* and actuator ball 97*a* do not move at least a portion of the flexible disk member 94 into the close port position (FIG. 10C).

In an example, the first pressure-actuated valve may include a free-fluid valve 48*b* and the second pressure-actuated valve may include a vent valve 48*c*. The free-fluid valve 48*b* may be configured to selectively transport air from the vent valve 48*c* into the free-fluid chamber 13. The vent valve 48*c* may be configured to selectively transport air from ambient atmosphere to the free-fluid valve 48*b*. In examples, one or more of the regulator valve 48*a*, the first pressure-actuated valve and the second pressure-actuated valve may be check valves. In the present example, each of the regulator valve 48*a*, the first pressure-actuated valve and the second pressure-actuated valve are check valves.

Referring to FIGS. 10A-10C, in an example, the integrated multifunctional valve device 88 may include a capillary relief valve 49. In an example, the flexible disk member 94, the first seat member 95, the first housing member 98*a*, the second seat member 96 and the second port 93 form a capillary relief valve 49 corresponding to the open position of the regulator valve 48*a*. In examples, the second housing member 98*b*, the actuator ball 97*a*, the flexible disk member 94, the first seat member 95, the first housing member 98*a*, the second seat member 96, and the second port 93 form a capillary relief valve 49 corresponding to the open position of the regulator valve 48*a*. The capillary path 99 may be configured to selectively transport air from the second port 93 to the regulated chamber 12. In an example, the capillary path 99 selectively transports air from the second port 93 to the regulated chamber 12 based on a respective state 15 of the regulated chamber 12 such as the backpressure regulation state 55*b* (FIG. 5B).

The present disclosure has been described using non-limiting detailed descriptions of examples thereof that are provided by way of example and are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples that are illustrative and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A fluid container usable with an image forming apparatus, the fluid container comprising:

a housing unit;

a free-fluid chamber disposed in the housing unit, the free-fluid chamber configured to store fluid;

a regulated chamber disposed in the housing unit, the regulated chamber including a regulator unit and an outlet, wherein the regulator unit is to be in a plurality of expansion states, the regulator unit is configured to regulate respective fluid therein, and the outlet is configured to transport the respective fluid from the regulated chamber; and a plurality of valves disposed in the housing unit, wherein at least one of the plurality of valves is configured to selectively stop fluid communication between the regulated chamber and the free-fluid chamber based on a respective state of the regulated chamber and wherein at least one of the plurality of valves is configured to selectively open and close a port corresponding to the respective expansion state of the regulator unit;

wherein the respective state includes a backpressure regulation state, a hyperinflation priming and/or purging state, and a normal and/or altitude robust state.

2. The fluid container according to claim 1, wherein the plurality of valves comprise:

at least two of a wet flow valve configured to selectively establish fluid communication between the regulated chamber and the free-fluid chamber, a regulator valve configured to selectively establish fluid communication between the regulated chamber and ambient atmosphere, a free-fluid valve configured to selectively establish fluid communication between the free-fluid chamber and the ambient atmosphere, and a vent valve configured to selectively establish fluid communication between the ambient air and the free-fluid chamber.

3. The fluid container according to claim 2, further comprising:

a capillary relief valve formed by a flexible disk member, a first seat member, a first housing member, a second seat member, and a second port, wherein a capillary path is configured to selectively transport air from the second port to the regulated chamber based on the respective state of the regulated chamber.

4. The fluid container according to claim 3, wherein the plurality of valves comprise each of the wet flow valve, the regulator valve, the free-fluid valve, the vent valve and the capillary relief valve such that at least one of the valves is a check valve.

5. The fluid container according to claim 4, wherein, in the hyperinflation priming and/or purging state, the regulator unit is configured to pressurize the regulated chamber to a positive pressure to perform at least one of a priming function and a purging function, such that the wet flow valve is closed, the regulator valve is closed, the free-fluid valve is closed, the vent valve is closed, and the capillary relief valve is closed.

6. The fluid container according to claim 4, wherein, in the backpressure regulation state, the regulator unit is configured to form a negative pressure in the regulated chamber to perform a controlled fluid delivery function, such that the wet flow valve is open, the regulator valve is open, the free-fluid valve is open, the vent valve is open, and the capillary relief valve is open.

7. The fluid container according to claim 4, wherein, in the normal and/or altitude robust state, the regulator unit is in a partially expanded state configured to form a negative pressure in the regulated chamber to perform at least a leak prevention function, such that the wet flow valve is open, the regulator valve is closed, the free-fluid valve is closed, the vent valve is closed, and the capillary relief valve is closed.

8. The fluid container according to claim 2, wherein the wet flow valve comprises a normally open pressure-actuated valve, the regulator valve comprises a pilot-operated regulator valve, the free-fluid valve comprises a normally open pressure-actuated valve, the vent valve comprises a normally open pressure-actuated valve, and the capillary relief valve comprises a normally closed relief valve.

9. A fluid container usable with an image forming apparatus having a fluid container receiver, a fluid detection chamber and a fluid applicator assembly, the fluid container comprising:

a housing unit including a free-fluid chamber and a regulated chamber configured to store fluid, the regulated chamber including a regulator unit configured to regulate respective fluid therein and an outlet configured to transport the respective fluid from the regulated chamber, wherein the regulated chamber is to be in a plurality of states including a backpressure regulation state, a hyperinflation priming and/or purging state, and a normal and/or altitude robust state;

a plurality of valves disposed in the housing unit, at least one of the plurality of valves configured to selectively stop fluid communication between the regulated chamber and the free-fluid chamber in response to the regulated chamber entering the hyperinflation priming and/or purging state; and wherein the regulator unit is configured to pressurize the regulated chamber to a positive pressure to perform at least one of a priming function and a purging function of one or more of the fluid detection chamber, the regulated chamber and the fluid applicator assembly in response to the regulated chamber entering the hyperinflation priming and/or purging state.

10. The fluid container according to claim 9, further comprising:

a capillary relief valve formed by a flexible disk member, a first seat member, a first housing member, a second seat member, and a second port, wherein a capillary path is configured to selectively transport air from the second port to the regulated chamber based on a respective state of the regulated chamber.

11. The fluid container according to claim 9, wherein, in the backpressure regulation state, the regulator unit is configured to form a negative pressure in the regulated chamber to perform a controlled fluid delivery function; and, in the normal and/or altitude robust state, the regulator unit is in a partially expanded state configured to form a negative pressure in the regulated chamber to perform at least a leak prevention function.

12. A fluid container usable with an image forming apparatus, the fluid container comprising:

a housing unit;

a free-fluid chamber disposed in the housing unit, the free-fluid chamber configured to store fluid;

a regulated chamber disposed in the housing unit, the regulated chamber including a regulator unit and an outlet, wherein the regulated chamber is to be in a plurality of states, the regulator unit is to regulate respective fluid therein, and the outlet is to transport the respective fluid from the regulated chamber; and a plurality of valves disposed in the housing unit, wherein the plurality of valves comprise a capillary relief valve formed by a flexible disk member, a first seat member, a first housing member, a second seat member, and a second port, wherein a capillary path is to selectively transport air from the second port to the regulated chamber based on a respective state of the regulated chamber, wherein the plurality of valves comprise a wet flow valve to selectively establish fluid communication between the regulated chamber and the free-fluid chamber, and wherein the plurality of valves comprise at least one of a regulator valve to selectively establish fluid communication between the regulated chamber and ambient atmosphere, a free-fluid valve to selectively establish fluid communication between the free-fluid chamber and the ambient atmosphere, and a vent valve to selectively establish fluid communication between the ambient air and the free-fluid chamber.

13. The fluid container according to claim 12, wherein the plurality of valves comprise each of the wet flow valve, the regulator valve, the free-fluid valve, the vent valve, and the capillary relief valve such that at least one of the valves is a check valve.

14. The fluid container according to claim 12, wherein the plurality of states include a backpressure regulation state, a hyperinflation priming and/or purging state, and a normal and/or altitude robust state.

15. The fluid container according to claim 14, wherein:

in the hyperinflation priming and/or purging state, the regulator unit is to pressurize the regulated chamber to a positive pressure to perform at least one of a priming function and a purging function;

in the backpressure regulation state, the regulator unit is to form a negative pressure in the regulated chamber to perform a controlled fluid delivery function; and in the normal and/or altitude robust state, the regulator unit is in a partially expanded state to form a negative pressure in the regulated chamber to perform at least a leak prevention function.

16. The fluid container according to claim 12, wherein the regulator unit is to be in a plurality of expansion states.

17. The fluid container according to claim 12, wherein the regulator valve comprises a lever member to move to selectively open and close a port corresponding to the respective expansion state of the regulator unit.

18. The fluid container according to claim 12, wherein the wet flow valve comprises a normally open pressure-actuated valve, the regulator valve comprises a pilot-operated regulator valve, the free-fluid valve comprises a normally open pressure-actuated valve, the vent valve comprises a normally open pressure-actuated valve, and the capillary relief valve comprises a normally closed relief valve.

* * * * *